US006142247A

United States Patent [19]

Pessier

[11] Patent Number: 6,142,247

[45] Date of Patent: Nov. 7, 2000

[54] BIASED NOZZLE ARRANGEMENT FOR ROLLING CONE ROCK BITS

[75] Inventor: Rudolf Carl Otto Pessier, Houston, Tex.

[73] Assignee: Baker Hughes Incorporated, Houston, Tex.

[21] Appl. No.: 08/683,920

[22] Filed: Jul. 19, 1996

[51] Int. Cl.[7] ..... E21B 10/18

[52] U.S. Cl. ..... 175/340; 175/393

[58] Field of Search ..... 175/340, 341, 175/393, 429

[56] References Cited

U.S. PATENT DOCUMENTS

| | | | |
|---|---|---|---|
| 930,759 | 8/1909 | Hughes . | |
| 1,480,014 | 1/1924 | Scott . | |
| 1,635,592 | 7/1927 | Wadsworth . | |
| 1,647,753 | 11/1927 | Scott et al. . | |
| 1,983,316 | 12/1934 | Scott et al. | 255/71 |
| 2,104,823 | 1/1938 | Sherman | 255/71 |
| 2,192,693 | 3/1940 | Payne | 255/71 |
| 2,294,544 | 9/1942 | Garfield | 255/71 |
| 2,333,746 | 11/1943 | Scott et al. | 255/71 |
| 3,144,087 | 8/1964 | Williams, Jr. | 175/339 |
| 4,516,642 | 5/1985 | Childers et al. | 175/340 |
| 4,611,673 | 9/1986 | Childers et al. . | |
| 4,657,093 | 4/1987 | Schumacher . | |
| 4,984,643 | 1/1991 | Isbell et al. . | |
| 4,989,680 | 2/1991 | Deane et al. | 175/340 |
| 5,096,005 | 3/1992 | Ivie et al. | 175/340 |

FOREIGN PATENT DOCUMENTS

| | | |
|---|---|---|
| 0452 584 A1 | 10/1991 | European Pat. Off. . |
| 0499 415 A2 | 10/1991 | European Pat. Off. . |
| 0499 416 A2 | 10/1991 | European Pat. Off. . |
| 9715057 | 10/1997 | United Kingdom . |

*Primary Examiner*—Roger Schoeppel
*Attorney, Agent, or Firm*—Felsman Bradley Vaden Gunter & Dillon, LLP; James E. Bradley

[57] ABSTRACT

An earth boring bit having a cone rotatably secured to a cantilevered bearing shaft and a nozzle that discharges a jet stream of fluid having a high velocity core and a lower velocity skirt. The high velocity core is fully contained in a space bounded by the backside of the cone, bit leg, borehole wall and a radial plane tangent to the tips of the heel teeth and intermittently strikes the exposed ends of the erosion and wear resistant teeth when the cone rotates the teeth on the trailing side in and out of the jet stream. Less than half of the fluid in the lower velocity skirt strikes the surface of the cone, while the remainder continues on a path toward the wall and the borehole bottom. The centerline of the high velocity core is aimed no lower than the corner of the borehole. The jet stream is confined on more than about 75 percent of its periphery by either the cone, bit leg or the wall of the borehole, reducing undesirable recirculation and turbulence and opening a large return flow area unobstructed by a high velocity jet stream.

24 Claims, 5 Drawing Sheets

BIASED NOZZLE ARRANGEMENT FOR ROLLING CONE ROCK BITS

BACKGROUND OF THE INVENTION

1. Field of the Invention

This invention relates to earth boring bits used in the oil, gas and mining industries, especially those having nozzle arrangements to prevent the cutter teeth from "balling up" with compacted cuttings from the earth.

2. Background Information

Howard R. Hughes invented a drill bit with rolling cones used for drilling oil and gas wells, calling it a "rock bit" because it drilled from the outset with astonishing ease through the hard cap rock that overlaid the producing formation in the Spindletop Field near Beaumont, Tex. His bit was an instant success, said by some the most important invention that made rotary drilling for oil and gas commercially feasible the world over (U.S. Pat. No. 930,759, "Drill", Aug. 10, 1909). More than any other, this invention transformed the economies of Texas and the United States into energy producing giants. But his invention was not perfect.

While Mr. Hughes' bit demolished rock with impressive speed, it struggled in the soft formations such as the shales around Beaumont and in the Gulf Coast of the United States. Shale cuttings sometimes compacted between the teeth of the "Hughes" bit, until it could no longer penetrate the earth. When pulled to the surface, the bit was often, as the drillers said, "balled up" with shale—sometimes until the cutters could no longer turn. Even moderate balling up slowed the drilling rate and caused generations of concern within Hughes' and his competitors' engineering organizations.

Creative and laborious efforts ensued for decades to solve the problem of bits "balling-up" in the softer formations, as reflected in the prior art patents. Impressive improvements resulted, including a bit with interfitting or intermeshing teeth in which circumferential rows of teeth on one cutter rotate through opposed circumferential grooves, and between rows of teeth, on another cutter. It provided open spaces on both sides of the inner row teeth and on the inside of the heel teeth. Material generated between the teeth was displaced into the open grooves, which were cleaned by the intermeshing rows of teeth. It was said, and demonstrated during drilling, " . . . the teeth will act to clear each other of adhering material." (Scott, U.S. Pat. No. 1,480,014, "Self-Cleaning Roller Drill", Jan. 8, 1924.) This invention led to a two cone bit made by " . . . cutting the teeth in circumferential rows spaced widely apart . . . " This bit included " . . . a series of long sharp chisels which do not dull for long periods." The cutters were true rolling cones with intermeshing rows of teeth, and one cutter lacked a heel row. The self cleaning effect of intermeshing thus extended across the entire bit, a feature that would resist the tendency of the teeth becoming balled-up in soft formations. (Scott, U.S. Pat. No. 1,647,753, "Drill Cutter", Nov. 1, 1927.)

Interfitting teeth are shown for the first time on a three cone bit in U.S. Pat. No. 1,983,316. The most significant improvement being the width of the grooves between teeth, which were twice as wide as those on the two cone structure without increasing uncut bottom. This design also combines narrow interfitting inner row teeth with wide non-interfitting heel rows.

A further improvement in the design is shown in U.S. Pat. No. 2,333,746, in which the longest heel teeth were partially deleted, a feature that decreased balling and enhanced penetration rate. A refinement of the design was the replacement of the narrow inner teeth with fewer wide teeth, which again improved performance in shale drilling.

By now the basic design of the three cone bit was set: (1) All cones had intermeshing inner rows, (2) the first cone had a heel row and a wide space or groove equivalent to the width of two rows between it and the first inner row with intermeshing teeth to keep it clean, (3) a second cone had a heel row and a narrow space or groove equivalent to the width of a single row between it and the first inner heel without intermeshing teeth, and (4) a third cone had a heel and first inner row in a closely spaced, staggered arrangement. A shortcoming of this design is the fact that it still leaves a relatively large portion of the cutting structure out of intermesh and subject to balling.

Another technique of cleaning the teeth of cuttings involved flushing drilling fluid or mud directly against the cutters and teeth from nozzles in the bit body. Attention focused on the best pattern of nozzles and the direction of impingement of fluid against the teeth. Here, divergent views appeared, one inventor wanting fluid from the nozzles to " . . . discharge in a direction approximately parallel with the taper of the cone" (Sherman, U.S. Pat. No. 2,104,823, "Cutter Flushing Device", Jan. 11, 1938), while another wanted drilling fluid discharged " . . . approximately perpendicular to the base [heel] teeth of the cutter." (Payne, U.S. Pat. No. 2,192,693, "Wash Pipe", Mar. 5, 1940.)

A development concluded after World War II seemed for a while to solve completely the old and recurrent problem of bit balling. A joint research effort of Humble Oil and Refining Company and Hughes Tool Company resulted in the "jet" bit. This bit was designed for use with high pressure pumps and bits with nozzles (or jets) that pointed high velocity drilling fluid between the cones and directly against the borehole bottom, with energy seemingly sufficient to quickly disperse shale cuttings, and simultaneously, keep the cutters from balling up because of the resulting highly turbulent flow condition between the cones. This development not only contributed to the reduction of bit balling, but also addressed another important phenomenon which became later known as chip holddown.

From almost the beginning, Hughes and his engineers recognized variances between the drilling phenomena experienced under atmospheric condition and those encountered deep in the earth. Rock at the bottom of a borehole is much more difficult to drill than the same rock brought to the surface of the earth. Model sized drilling simulators showed in the 1950's that removal of cuttings from the borehole bottom is impeded by the formation of a filter cake on the borehole bottom. "Laboratory Study Of Effect Of Overburden, Formation And Mud Column Pressures On Drilling Rate Of Permeable Formation", R. A. Cunningham and J. F. Eenick, presented at the 33rd Annual Fall Meeting of the S.P.E., Houston, Tex., Oct. 5–8, 1958. While a filter cake formed from drilling mud is beneficial and essential in preventing sloughing of the wall of the hole, it also reduces drilling efficiencies. If there is a large difference between the borehole and formation pressure, also known as overbalance or differential pressure, this layer of mud mixes with cuttings and fines from the bottom and forms a strong mesh-like layer between the cutter and the formation, which keeps the cutter teeth from reaching virgin rock. The problem is accentuated in deeper holes since both the mud weights and hydrostatic pressure are inherently higher. One approach to overcome this perplexing problem is the use of ever higher jet velocities in an attempt to blast through the filter cake and dislodge cuttings so they may be flushed through the well bore to the surface.

The filter cake problem and the balling problem are distinct since filter cake build up, also known as bottom balling, occurs mainly at greater depth with weighted muds, while cutting structure balling is more typical at shallow depths in more highly reactive shales. Yet, these problems can overlap in the same well since various formations and long distances must be drilled by the same bit. Inventors have not always made clear which of these problems they are addressing, at least not in their patents. However, a successful jet arrangement must deal with both problems; it must clean the cones but also impinge on bottom to overcome bottom balling.

The direction of the jet stream and the area of impact on the cutters and borehole bottom receives periodic attention of inventors. Some interesting, if unsuccessful, approaches are disclosed in the patents. One patent provides a bit that discharges a tangential jet that sweeps into the bottom corner of the hole, follows a radial jet, and includes an upwardly directed jet to better sweep cuttings up the borehole. (Williams, Jr., U.S. Pat. No. 3,144,087, "Drill Bit With Tangential Jet", Aug. 11, 1964. The cutters have an unusual tooth arrangement, including one with no heel row of teeth, and two of the cutters do not engage the wall of the borehole. One nozzle extends through the center of the cutter and bearing shaft and another exits at the bottom of the "leg" of the bit body, near the corner of the borehole.

There is some advantage to placing the nozzles as close as possible to the bottom of the borehole. (Feenstra, U.S. Pat. No. 3,363,706, "Bit With Extended Jet Nozzles", Jan. 16, 1968. The prior art also shows examples of efforts to orient the jet stream from the nozzles such that they partially or tangentially strike the cutters and then the borehole bottom at an angle ahead of the cutters. (Childers, et al, U.S. Pat. No. 4,516,642, "Drill Bit Having Angled Nozzles For Improved Bit and Well Bore Cleaning", May 14, 1985.)

A more recent approach to the problem of bit balling is disclosed in the patent to Isbell and Pessier, U.S. Pat. No. 4,984,643, "Anti-Balling Earth Boring Bit", Jan. 15, 1991. Here, a nozzle directs a jet stream of drilling fluid with a high velocity core past the cone and inserts of adjacent cutters to the borehole bottom to break up the filter cake, while a lower velocity skirt strikes the material packed between the inserts of adjacent cones. The high velocity core passes equidistant between a pair of cutters, and the fluid within the skirt engages each cutter in equal amounts. While significant improvement was noted in reducing bit and bottom balling, the problem persists under some drilling conditions.

In spite of the extensive efforts of inventors laboring in the rock bit art since 1909, including those of the earliest, Howard R. Hughes, the ancient problem of rock bits "balling up" persists. The solutions of the past prevent balling in many drilling environments, and the bit that balls up so badly that the cutters will no longer turn is a species of the problem that has all but completely disappeared. Now, the problem is much more subtle and often escapes detection. It only occurs in the downhole environment and thus is largely unappreciated as a cause of poor drilling performance in the field. Simulation has allowed duplication of that environment and thus led to substantial refinements and improvements of earlier designs.

SUMMARY OF THE INVENTION

It is therefore the general object of the invention to improve the earth boring bit to minimize both cutting structure and borehole bottom balling.

Accordingly, the improvement is achieved in an earth boring bit of the type having preferably three cutters or cones rotatably secured on cantilevered bearing shafts, with sufficient spaces therebetween for nozzles to discharge fluid against the borehole bottom. A nozzle discharges during drilling a jet stream of fluid having a high velocity core and a lower velocity skirt. The high velocity core being fully contained in a small triangular space bounded by the backside of the cutter, bit leg, borehole wall and a radial plane tangent to the tips of the heel teeth. The high velocity core intermittently strikes the exposed ends of the teeth when the cone rotates the teeth in and out of the jet stream. About one third of the fluid in the lower velocity skirt strikes the surface of the cone, while the remainder continues on a path toward the wall and borehole bottom. The fluid striking the teeth and the cone surface does so on the trailing side of the rotating cone where the teeth are leaving the borehole bottom. When the high velocity core is not striking the cutting elements, it can pass unobstructed between adjacent teeth to the borehole bottom. The jet stream is biased or slanted directionally by the placement and orientation of the nozzle such that the high velocity core is substantial tangential to the trailing side of the associated cone. The high velocity core and lower velocity skirt of the jet stream is thus confined on more than 75 percent of its periphery by either the cone or the wall of the borehole, thus reducing undesirable recirculation and turbulence and opening up a large return flow area adjacent to the following cone unobstructed by the high velocity jet stream.

Additional objects, features and advantages of the invention will be apparent in the following description.

DESCRIPTION OF THE PREFERRED EMBODIMENT

Figure 1:
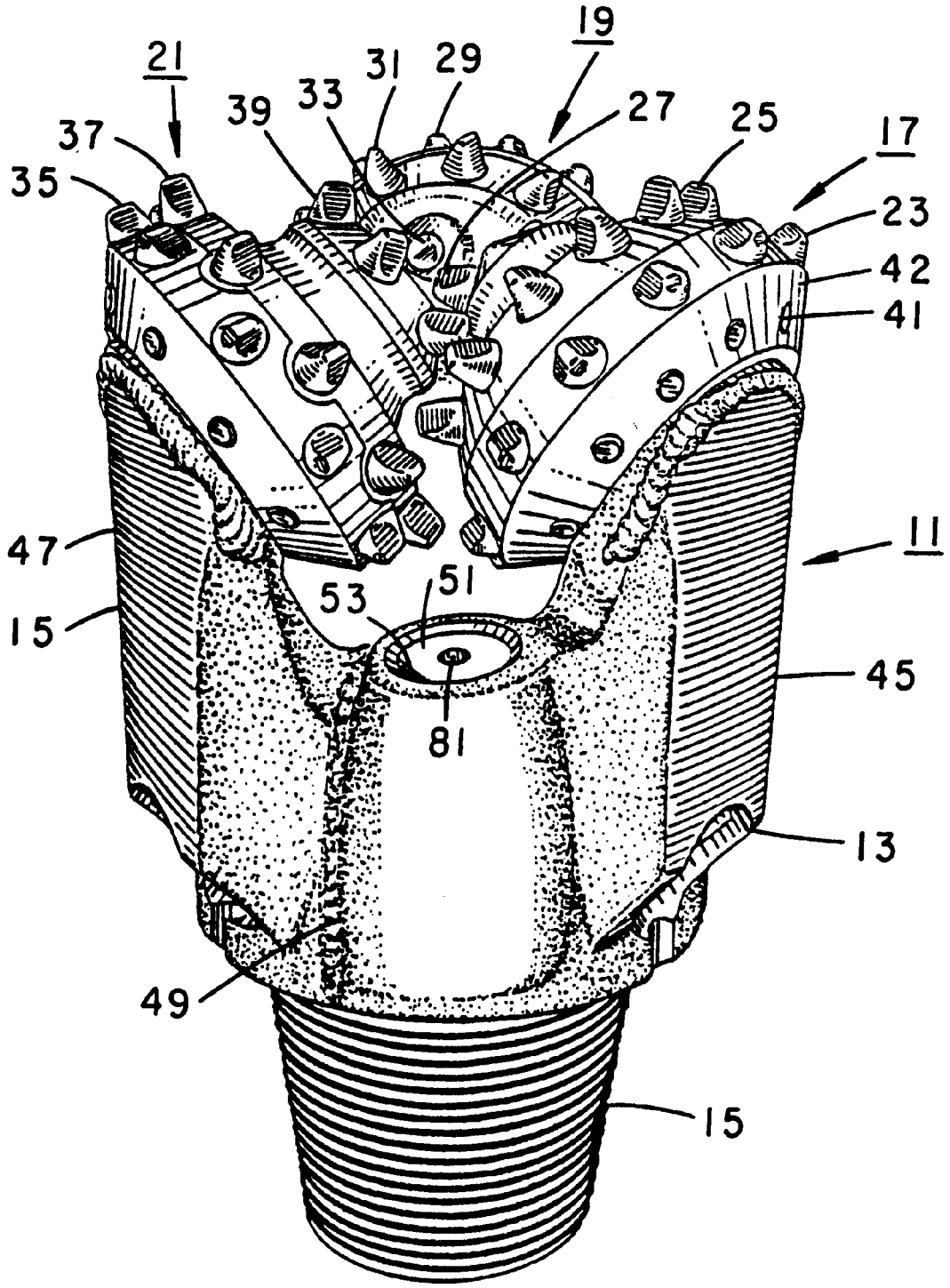
FIG. 1 PRIOR ART
FIG. 1 is a perspective view of a prior art earth boring bit of the type having sintered tungsten carbide inserts used as earth disintegrating teeth in cones rotatably secured to bearing shafts.

The numeral 11 in FIG. 1 of the drawing designates a prior art "Hughes" JO5 earth boring bit of the type having three rotatable cutters, each having wear resistant inserts used as earth disintegrating teeth.

A bit body 13 has an upper end which is threaded at 15 to be secured to a drill string member (not shown) used to raise and lower the bit in a wellbore and to rotate the bit during drilling. This particular bit has three cones designated by the numerals 17, 19 and 21.

The inserts that form the earth disintegrating teeth in bit 11 are arranged in circumferential rows, here designated by the numerals 23, 25 and 27 on cone 17; by the numerals 29, 31 and 33 on cone 19; and by the numerals 35, 37 and 39 on cone 21. Additional inserts, called "gage" inserts 41 are shown protruding from a gage surface 42 on each cone, such as cone 17.

The circumferential rows of inserts 23, 29 and 35 are known as "heel row" inserts that disintegrate formation at the outermost region adjacent the wall of the hole. Typically, there is one cone 21, as shown in FIG. 1, in which there is one row 37 that is very closely spaced to a heel row 35. This row 37 is known by various names in the industry, such as the "hell catching row" or the "adjacent heel row."

The inserts of row 37 are widely spaced as are the inserts in heel row 35. The word "spacing" refers here to the distance between adjacent inserts a row, but sometimes refers to the distance between inserts of adjacent rows. The wide spacing of the inserts in row 37 results from this row being closely spaced with respect to heel row 35. Here, rows 37 and 35 overlap in an axial direction, meaning a direction measured along a line parallel with the rotational axis of the cone. The wide spacing of the insert 37 causes excessive loading as they traverse the bottom of the borehole, frequently breaking them and giving rise to the designation of "hell catching row."

The close relationship and spacing between inserts 37 and 35 of cone 21 causes these inserts to experience "balling" or "balling up" of cuttings between them. Balling occurs since the close axial spacing of inserts in adjacent rows 37, 35 enables the adherence and build up of cuttings in the narrow and close open spaces between them.

Figure 2:
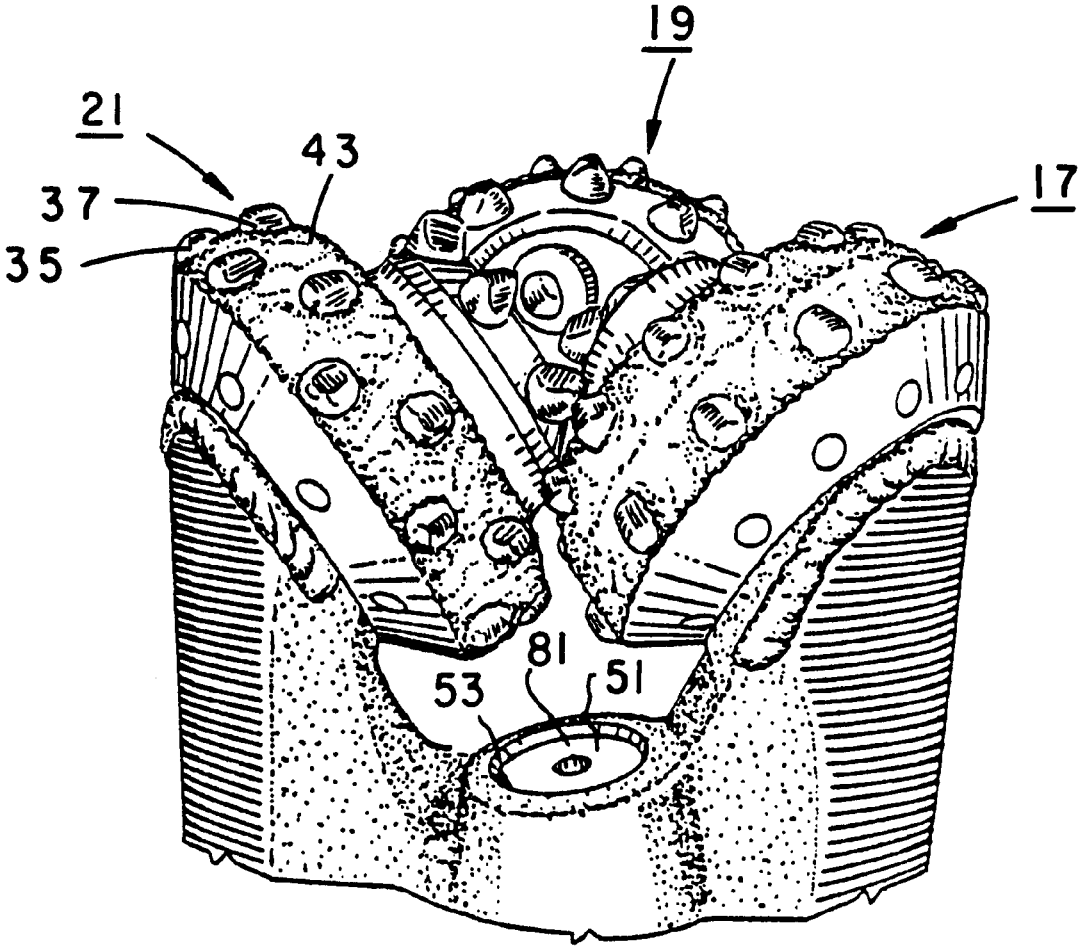
FIG. 2 PRIOR ART
FIG. 2 is a fragmentary perspective view of portions of the prior art bit shown in FIG. 1 after having been run in a formation that caused some of the teeth to ball-up.

FIG. 2 is an illustration of portions of the prior art bit of FIG. 1, showing the presence of compacted shale 43 or other earth formation that has "balled up" or clogged the open spaces between some of the inserts. This condition impedes the progress of the bit during drilling by preventing the teeth or inserts from penetrating completely the earth. When a bit reaches the condition shown in FIG. 2, the rate of penetration (ROP) falls substantially.

Balling impedes the progress of the bit during drilling by preventing the teeth or inserts from effectively penetrating the earth. When a bit reaches the condition shown in FIG. 2, the rate of penetration (ROP) falls by as much as fifty percent.

The bit 11 of FIG. 1 is composed of sections 45, 47 (and another not shown) that are welded as at 49. Although not shown in FIG. 1, the interior of the bit body is hollow to contain fluid directed into three passages, one each of which supplies a nozzle or jet 51. Typically, the nozzle 51 is formed of a wear resistant material such as sintered tungsten carbide retained in a receiving drilled hole with a snap ring 53.

Figure 3:
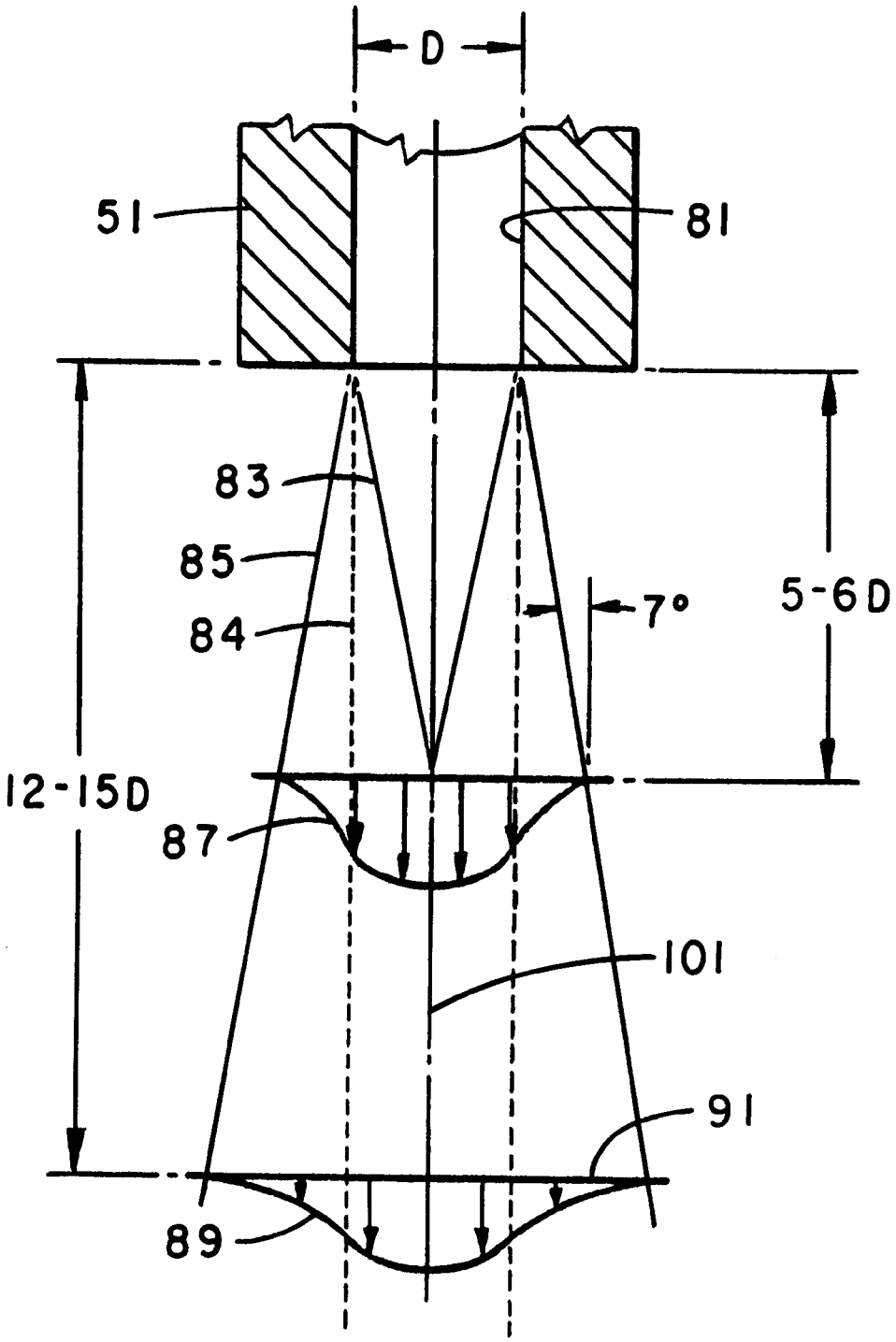
FIG. 3 PRIOR ART
FIG. 3 is a longitudinal and schematic view of a jet or nozzle used in an earth boring bit, showing the manner in which the fluid exits the nozzle in a high velocity core and a diverging low velocity skirt.

The bit of FIG. 1 has in each of its three nozzles 51 an orifice 81 of selected diameter. Fluid is pumped from the surface of the well, through the drill pipe (not shown) and through the three nozzles 51 of the bit. As shown in FIG. 3, fluid is discharged in a core 84 of high velocity and in a skirt 85 of lower velocity. At each distance from the end of the nozzle 51 there is a velocity profile, two being indicated by the numerals 87 and 89. Fluid exits each nozzle at a high velocity and entrains and accelerates the surrounding fluid at its boundary or skirt 85, as shown in FIG. 3. As more fluid is entrained with increasing distance from the nozzle exit, the jet diameter increases to define the boundary 85. The angle of spread is typically seven degrees. The bottom of the hole 91 is illustrated schematically and is usually a distance of approximately 12 to 15 nozzle diameters from the end of the nozzle exit for bits of the type shown in FIG. 1. The jet passes through the tightest spot between the cones of FIG. 1 approximately six nozzle diameters from the nozzle exit. Thus, the jet is approximately equidistant from the two adjacent cones, and the high velocity core does not strike either cone or the teeth of either cone. A small portion of the low velocity skirt strikes the teeth and the cones. Inside the core 84 of the jet is a converging conical region 83 in which the jet velocity is equal to the nozzle exit velocity. As indicated in FIG. 3 the jet stream is divided into three regions: (1) the low velocity outer region between the boundary or skirt 85 and the core 84, (2) the high velocity, generally cylindrical core 84 where the velocity is substantially higher than at the boundary 85, as indicated in the velocity profiles, and (3) the highest velocity conical region 83.

Figure 4:
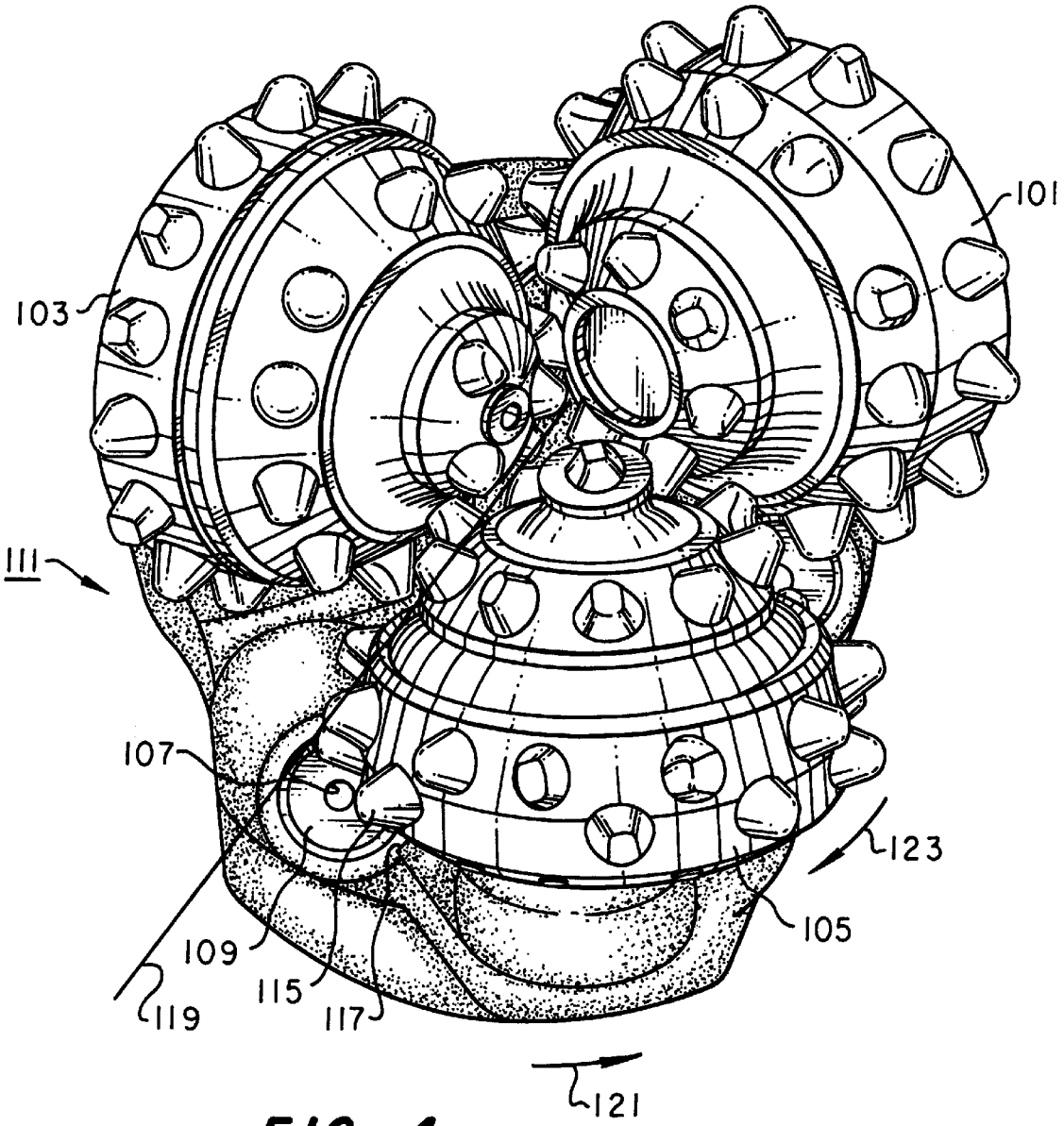
FIG. 4 illustrates portions of the preferred bit, as seen from the bottom, to show the improved position of a nozzle relative to the cones.

FIG. 4 shows a view of the cones 101, 103 and 105 of the present invention as seen looking directly down the axis of the orifice 107 of nozzle 109 of the bit 111 in a preferred embodiment designed for sticky nonabrasive shales. The placement of the nozzle 109 is such that the high velocity core 113 of the jet (indicated in FIG. 5), which is the same diameter as the nozzle orifice 107, intermittently strikes the exposed ends of selected ones of the teeth heel cutting elements or teeth 115 when the cone 105 rotates the teeth in and out of the high velocity core 113 during drilling. Intermittently the high velocity core 113 also strikes the borehole bottom and wall of the borehole. The jet stream is biased or slanted directionally by the placement and orientation of the nozzle 109 such that the high velocity core 113 is fully contained in space bounded by the backside or backface of cone 105, bit leg 117, the borehole wall and a radial plane 119 (see FIG. 4) through the rotational axis (not shown) of the bit and tangent to the heel teeth 115 at their outmost sweep during rotation away from the borehole bottom. The normal bit rotation is indicated by the arrow 121 and the rotation of cone 105 by the arrow 123. The centerline or axis (not shown) of the high velocity jet intersects substantially the corner of the borehole, preferably not inside this corner but on the wall. About one-third of the jet strikes the surface of the cone and is confined on more than 75 percent of its periphery by either the cone, the leg or the wall of the borehole, thus reducing undesirable recirculation and turbulence. This opens a large return flow area adjacent to the leading side of the trailing cone, which is unobstructed by the jet stream.

The teeth 115 are constructed in this instance of erosion and wear resistant sintered tungsten carbide, including those with a man-made diamond coating, and erosion from the fluid flowing in the high velocity core 113 is minimized. The cone 105, like the other cones 101 and 103, is constructed of a high alloy, partially carburized and hardened steel, which resists erosion by the jet stream. The erosion resistance of the cones is further enhanced with a hard metal coating for more abrasive drilling muds. A high velocity oxygen fuel (HVOF) process was used to spray a thin 0.015 inch layer of tungsten carbide on the cone in the area of the heel teeth with successful test results that showed enhanced erosion resistance.

Figure 5:
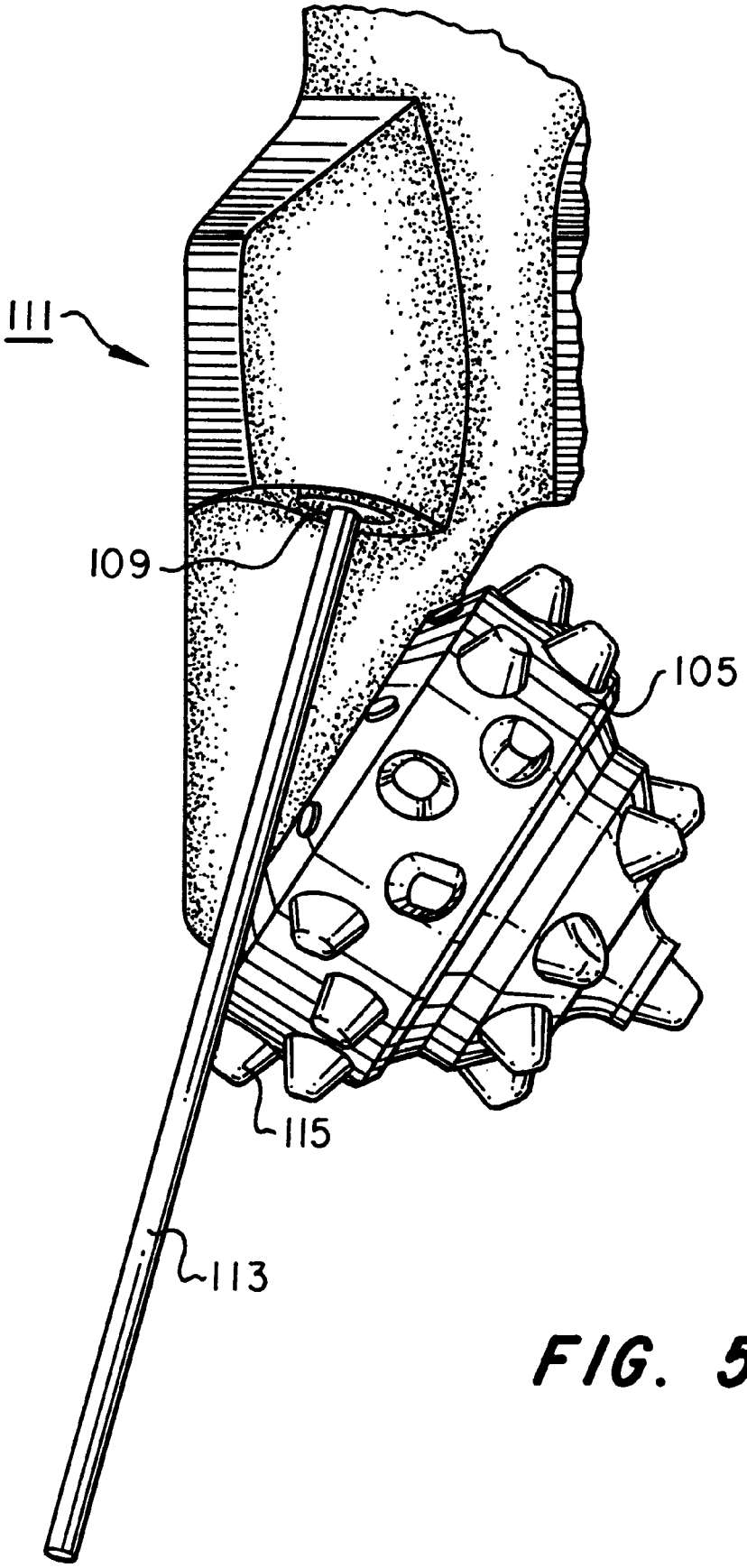
FIG. 5 is a representation of portions of the bit of FIG. 4, as seen in a side view, to show the relationship between a nozzle, one bit leg and two of the cones.

As shown in FIG. 5, the high velocity core 113 is aimed at the wall above the corner of the borehole (not shown but explained above) to more effectively sweep cuttings out of the corner. During drilling, the bit is rotated counterclockwise a seen in FIG. 4 by the arrow 121 and the fluid in the high velocity core 113 (FIG. 5) strikes the exposed ends of teeth 115 on the trailing side of the cone 105 where the teeth are leaving the borehole bottom.

Preferably, each of the other cones 101, 103, 105 of the illustrated three cone bit has a nozzle arranged like nozzle 109 to cause fluid to intermittently impinge upon selected teeth, part of the associated cutter and a region of the borehole in the above described manner. This is advantageous in dislodging with the high velocity core those cuttings from the teeth that tend most to ball-up, just after these teeth leave the borehole bottom. Also, the low velocity skirt partially washes the cone surface over a broader area in the region most likely to ball-up as this surface is leaving the borehole bottom. In the time interval when the fluid does not impinge on the teeth, it passes between adjacent teeth and continues to the region of the borehole bottom where a large volume of cuttings accumulates to wash them away before the teeth of the trailing cone engages the formation. As a consequence, there is a reduced likelihood that cuttings can accumulate on bottom and between the teeth in the most troublesome outermost areas of the cones, the ones most likely to ball-up.

While the invention has been shown in only one of its forms, it should be apparent to those skilled in the art that it is not thus limited, but is susceptible to various changes and modifications without departing from the spirit thereof.

I claim:

1. An earth boring bit comprising:

a bit body adapted for attachment to a drill string;

at least one bearing shaft extending downwardly from the body;

a cutter rotatably secured to said bearing shaft, including teeth with exposed ends composed at least partially of wear resistant material and having a selected projection from the surface of the cutter to form cuttings from the borehole bottom, each cutter having a backface, a gage area adjacent the backface, and a heel area inward of the gage area;

a nozzle retained in the body, including an orifice to discharge a jet stream of fluid having a high velocity core, the high velocity core being directed within a space bounded by the backface of the cutter, bit body, borehole wall and a radial plane tangent to the tips of the teeth in the heel area at their outermost sweep during rotation away from the borehole bottom;

whereby the high velocity jet is biased towards the heel and gage area of the cutter to dislodge cuttings from the cutter as well as the borehole bottom.

2. The invention defined by claim 1 wherein the high velocity core is aimed at the trailing side of the cutter on which the teeth are rotating upwardly into the jet stream during drilling.

3. The invention defined by claim 2 wherein the high velocity core intermittently strikes selected of the exposed ends of the teeth.

4. The invention defined by claim 3 wherein the teeth are heel teeth.

5. The invention defined by claim 2 wherein the center of the orifice is aimed at the wall of the borehole not lower than the corner the wall forms with the borehole bottom.

6. The invention defined by claim 3 wherein the teeth are formed at least partially of sintered tungsten carbide.

7. The invention defined by claim 3 wherein the teeth are formed at least partially of a man-made diamond surface over the sintered tungsten carbide.

8. The invention defined by claim 7 wherein the cutter is at least partially protected with a hard metal coating.

9. An earth boring bit comprising:

a bit body adapted for attachment to a drill string;

at least one bearing shaft extending downwardly from the body;

a cutter rotatably secured to the bearing shaft, including teeth exposed ends composed at least partially of wear resistant material and having a selected projection from the surface of the cutter to form cuttings from the borehole bottom;

at least one nozzle retained in the body, including an orifice to discharge a jet stream of fluid having a high velocity core with a diameter essentially the same as the orifice, there being a low velocity, diverging skirt of fluid surrounding the high velocity core;

the orifice being positioned such that a first portion of the fluid in the low velocity skirt strikes the cutter on the trailing side of the cutter and a second portion strikes the borehole wall and bottom;

whereby the fluid in the high velocity core and low velocity skirt dislodge cuttings from the cutter and the borehole bottom while avoiding substantial erosion of the cone.

10. The invention defined by claim 9 wherein the high velocity core is substantially tangential to the trailing side of the cone that exits the borehole bottom during drilling.

11. The invention defined by claim 9 wherein the first portion is smaller than the second portion.

12. The invention defined by claim 11 wherein the first portion is about one third of the total.

13. The invention defined by claim 9 wherein the center of the orifice is aimed at the wall of the borehole not lower than the corner the wall forms with the borehole bottom.

14. The invention defined by claim 9 wherein the teeth are formed at least partially of sintered tungsten carbide, secured to the cutter by interference fit.

15. The invention defined by claim 10 wherein the teeth are formed at least partially of a man-made diamond surface over the sintered tungsten carbide.

16. The invention defined by claim 14 wherein the cutter is at least partially protected with a hard metal coating.

17. The invention defined by claim 9 wherein the high velocity core is aimed at the exposed ends of selected teeth at an angle to intermittently strike them during rotation of the cone.

18. The invention defined by claim 17 wherein the selected teeth are heel teeth.

19. An earth boring bit comprising:

a bit body adapted for attachment to a drill string;

at least one bearing shaft extending downwardly from the body;

a cutter rotatably secured to said bearing shaft, including a plurality of cutting elements, each cutter having a backface, a gage surface adjacent the backface, and a heel surface inward of the gage surface;

at least one nozzle retained in the body, including an orifice to discharge a jet stream of fluid having a high velocity core, the high velocity core being directed within a space bounded by the cutter backface, the bit body, the wall of the borehole and a radial plane tangent to the tips of the cutting elements on the heel surface of the cutter at their outermost sweep during rotation away from the borehole bottom, wherein the high velocity jet is biased toward the heel and gage cutting elements and surfaces of the cutter to dislodge cuttings from the cutter as well as the borehole bottom.

20. The invention defined by claim 19 wherein the high velocity core is aimed at the trailing side of the cutter on which the teeth are rotating upwardly into the jet stream during drilling.

21. The invention defined by claim 19 wherein the high velocity core intermittently strikes selected of the exposed ends of the cutting elements.

22. The invention defined by claim 19 wherein the teeth are formed at least partially of sintered tungsten carbide.

23. The invention defined by claim 19 wherein the cutting elements are formed at least partially of a man-made diamond surface applied over a sintered tungsten carbide.

24. The invention defined by claim 19 wherein the cutter is at least partially protected with a hard metal coating.

* * * * *